US011746576B2

(12) United States Patent
Song

(10) Patent No.: US 11,746,576 B2
(45) Date of Patent: Sep. 5, 2023

(54) RETRACTABLE OUTSIDE DOOR HANDLE ASSEMBLY

(71) Applicants: Hyundai Motor Company, Seoul (KR); Kia Corporation, Seoul (KR)

(72) Inventor: Tae Kyung Song, Suwon-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 137 days.

(21) Appl. No.: 17/371,382

(22) Filed: Jul. 9, 2021

(65) Prior Publication Data

US 2022/0205289 A1 Jun. 30, 2022

(30) Foreign Application Priority Data

Dec. 24, 2020 (KR) ..... 10-2020-0182776

(51) Int. Cl.
*E05B 85/10* (2014.01)
*E05B 85/16* (2014.01)

(52) U.S. Cl.
CPC ..... *E05B 85/107* (2013.01); *E05B 85/16* (2013.01)

(58) Field of Classification Search
CPC ..... E05B 85/10; E05B 85/103; E05B 85/107; E05B 85/14; E05B 85/16; E05B 85/18; E05B 17/0041; E05B 17/0054; E05B 17/0058; E05B 5/00; E05B 5/003; E05B 79/06; E05B 77/36; E05B 77/38; E05B 77/42; E05Y 2800/422; Y10S 292/27; Y10S 292/56; Y10T 292/57
See application file for complete search history.

(56) References Cited

U.S. PATENT DOCUMENTS

2009/0119880 A1* 5/2009 Sibley ..... E05B 85/107 16/412
2015/0233154 A1* 8/2015 Smart ..... E05B 85/107 70/237
2021/0189778 A1* 6/2021 Sha ..... E05B 81/76
2022/0154500 A1* 5/2022 Jeong ..... E05B 81/04

FOREIGN PATENT DOCUMENTS

DE 102018112703 A1 * 11/2019 ..... F16H 57/021
KR 102157301 B1 * 9/2022 ..... E05B 81/90
WO WO-2020048858 A1 * 3/2020 ..... E05B 81/90

* cited by examiner

*Primary Examiner* — Kristina R Fulton
*Assistant Examiner* — Emily G. Brown
(74) *Attorney, Agent, or Firm* — Slater Matsil, LLP

(57) ABSTRACT

A retractable outside door handle assembly has a handle unit including an outside handle having a pushing portion and mounted on a handle housing. The outside handle is configured to protrude by rotating in a first direction. An actuator includes an operation rod configured to selectively push the pushing portion. A door latch lever is rotatably mounted on the handle housing and configured to rotate during protrusion of the outside handle by operation of the actuator. A damage prevention mechanism is located between the operation rod and the pushing portion and configured to push the pushing portion when the actuator is operated. The damage prevention mechanism is configured to prevent a pushing force of the pushing portion from being transmitted to the operation rod when the outside handle rotates in a second direction opposite the first direction in a protruded state.

20 Claims, 10 Drawing Sheets

RETRACTABLE OUTSIDE DOOR HANDLE ASSEMBLY

CROSS-REFERENCE TO RELATED APPLICATIONS

This application claims the benefit of Korean Patent Application No. 10-2020-0182776, filed in the Korean Intellectual Property Office on Dec. 24, 2020, which application is hereby incorporated herein by reference.

TECHNICAL FIELD

The present invention relates to a retractable outside door handle assembly.

BACKGROUND

In general, a vehicle is provided with a vehicle compartment having a predetermined size in which a driver or an accompanying occupant can board it, and a vehicle compartment opening door is provided to open and close the vehicle compartment.

The interior door handle is mounted on the inner side of the door facing the interior of the car so that the car compartment opening and closing door can be easily opened and closed by the occupant, and an outside door handle is mounted on the exterior surface facing the exterior of the car compartment.

Each door handle is connected to the door latch that fixes the door to the vehicle body, so that the door can be opened as the door latch is released according to the operation of each door handle.

The outside door handle is usually mounted to enable pivot movement on the outer panel of the door, and is installed to protrude outward along the width direction of the vehicle on the door outer panel so that the occupant can easily grasp it.

If the outside door handle is installed to protrude outward along the width direction of the vehicle as described above, the operator's ease of operation is improved, but the exterior beauty of the vehicle may be deteriorated due to the protruded outside door handle, and not only can it cause driving noise while the vehicle is driving, but also driving performance due to driving resistance can be deteriorated.

In recent years, in order to solve this problem, in some cases, the outside door handle protrudes from the door outer panel to the outside along the width direction of the vehicle by the drive of the actuator (motor) or is accommodated inside the receiving hole formed in the door outer panel. As a result, a retractable outside door handle is being developed that does not protrude outward from the door outer panel.

In the conventional retractable outside door handle assembly, the outside door handle is protruded from the door outer panel via an actuator via a link mechanism, or is accommodated into the receiving hole of the door outer panel, and the door is locked or released from the vehicle body. It is connected to a door lock mechanism including a cylinder and a door latch mechanism that directly locks or releases the door to the vehicle body.

However, if the door handle is closed by the occupant or by an external impact while the door handle is protruded by the actuator, there is a possibility that the actuator or the door handle will be damaged.

The above information disclosed in this Background section is only for enhancement of understanding of the background of the invention, and therefore it may contain information that does not form the prior art that is already known to a person of ordinary skill in the art.

SUMMARY

The present invention relates to a retractable outside door handle assembly. Particular embodiments relate to a retractable outside door handle assembly that can prevent damage to parts during malfunction with a simple structure.

Embodiments of the present invention provide a retractable outside door handle assembly that can prevent component damage in case of malfunction with a simple structure.

A retractable outside door handle assembly according to exemplary embodiments of the present invention may include a handle unit including an outside handle having a pushing portion and mounted on a handle housing to be able to protrude by rotating in a first direction, an actuator including an operation rod for selectively pushing the pushing portion, a door latch lever that is rotatably mounted on the handle housing and rotates during the operation of the outside handle protruded by the operation of the actuator, and a damage prevention mechanism provided between the operation rod and the pushing portion, pushing the pushing portion when the actuator is operated, and the damage prevention mechanism preventing the pushing force of the pushing portion from being transmitted to the actuating rod when the protruding outside handle rotates in a second direction opposite to the first direction.

The damage prevention mechanism may include a first body selectively contacting the pushing portion, a second body slidably connected to the first body and connected to the operation rod, and a selectable locking portion selectively blocking the relative movement of the first body and the second body.

The selectable locking portion may include a spring housing formed in the first body, a stopper elastic portion provided in the spring housing, a stopper supported by the stopper elastic portion, and a stopper groove formed in the second body and into which the stopper is inserted.

The retractable outside door handle assembly according to an exemplary embodiment of the present invention may further include a housing stopper formed on the handle housing, and a body stopper formed on the first body to selectively contact the housing stopper.

The second body may include a connection protrusion formed to connect with the operation rod.

The handle unit may further include a handle rotation pin that rotatably mounts the outside handle to the handle housing.

The retractable outside door handle assembly according to an exemplary embodiment of the present invention may further include a handle leg formed on the outside handle to enable contact with the door latch lever when protruding by the operation of the actuator.

The retractable outside door handle assembly according to an exemplary embodiment of the present invention may further include a handle spring that provides a reaction torque to the outside handle.

According to the retractable outside door handle assembly according to an exemplary embodiment of the present invention, it is possible to prevent component damage in case of malfunction with a simple structure.

In addition, the effect obtained or predicted by an exemplary embodiment of the present invention will be disclosed directly or implicitly in the detailed description of an exemplary embodiment of the present invention. That is, various effects predicted according to an exemplary embodiment of the present invention will be disclosed within a detailed description to be described later.

BRIEF DESCRIPTION OF THE DRAWINGS

Since these drawings are for reference only to explain an exemplary embodiment of the present invention, the technical idea of the present invention should not be construed as being limited to the accompanying drawing.

Figure 1:
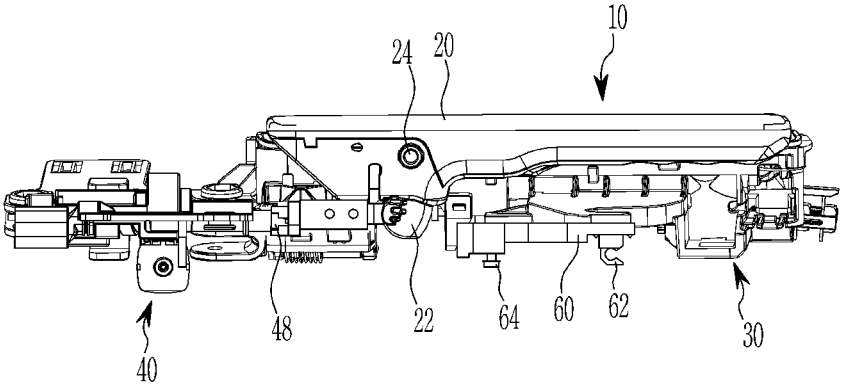
FIG. 1 is a front view of a retractable outside door handle assembly according to an exemplary embodiment of the present invention.

The following elements may be used in connection with the drawings to describe embodiments of the present invention.

| | |
|---|---|
| 10: handle unit | 20: outside handle |
| 22: pushing portion | 24: handle rotation pin |
| 26: handle leg | 28: handle spring |
| 30: handle housing | 32: housing stopper |
| 40: actuator | 48: operation rod |
| 60: door latch lever | 62: lever hook |
| 64: door latch lever pin | |
| 70: damage prevention mechanism | |
| 80: first body | 82: spring housing |
| 84: body stopper | 90: second body |
| 92: stopper groove | 94: connection protrusion |
| 100: selectable locking portion | 102: stopper elastic portion |
| 104: stopper | |

DETAILED DESCRIPTION OF ILLUSTRATIVE EMBODIMENTS

In the following detailed description, only certain exemplary embodiments of the present invention have been shown and described, simply by way of illustration.

As those skilled in the art would realize, the described embodiments may be modified in various different ways, all without departing from the spirit or scope of the present invention.

Throughout the specification, parts marked with the same reference number mean the same constituent elements.

In the drawings, the thickness of layers, films, panels, regions, etc. are exaggerated for clarity.

When a part such as a layer, film, region, or plate is said to be "on" another part, this includes not only the case directly above the other part, but also the case where there is another part intervening.

In contrast, when an element is referred to as being "directly on" another element, there are no intervening elements present.

Throughout the specification, when a part "includes" a certain component, it means that other components may be further included rather than excluding other components unless specifically stated to the contrary.

Exemplary embodiments of the present invention will hereinafter be described in detail with reference to the accompanying drawings.

Figure 2:
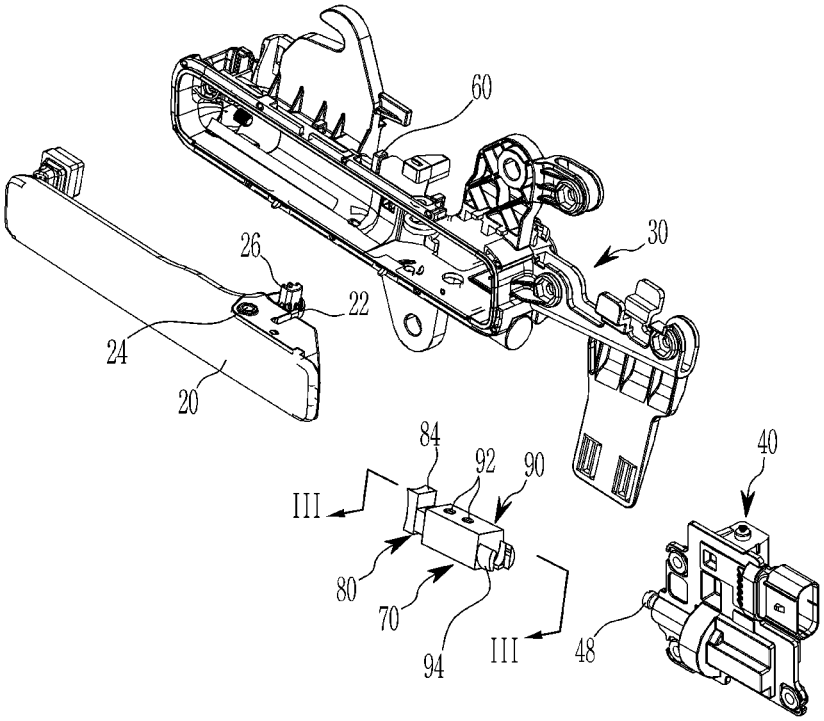
FIG. 2 is an exploded perspective view of a retractable outside door handle assembly according to an exemplary embodiment of the present invention.

FIG. 1 is a front view of a retractable outside door handle assembly according to an exemplary embodiment of the present invention, and FIG. 2 is an exploded perspective view of a retractable outside door handle assembly according to an exemplary embodiment of the present invention.

Referring to FIG. 1 and FIG. 2, a retractable outside door handle assembly according to exemplary embodiment of the present invention may include a handle unit 10 including an outside handle 20 having a pushing portion 22 and mounted on a handle housing 30 to be able to protrude by rotating in a first direction (referring to FIG. 6), an actuator 40 including an operation rod 48 for selectively pushing the pushing portion 22, a door latch lever 6*o* that is rotatably mounted on the handle housing 30 and rotates during the operation of the outside handle 20 protruded by the operation of the actuator 40, and a damage prevention mechanism 70 provided between the operation rod 48 and the pushing portion 22, pushing the pushing portion 22 when the actuator 40 is operated, and the damage prevention mechanism 70 preventing the pushing force of the pushing portion 22 from being transmitted to the operation rod 48 when the protruding outside handle 20 rotates in a second direction (referring to FIG. 6) opposite to the first direction.

The handle unit 10 may further include a handle rotation pin 24 for rotatably mounting the outside handle 20 to the handle housing 30.

Figure 3:
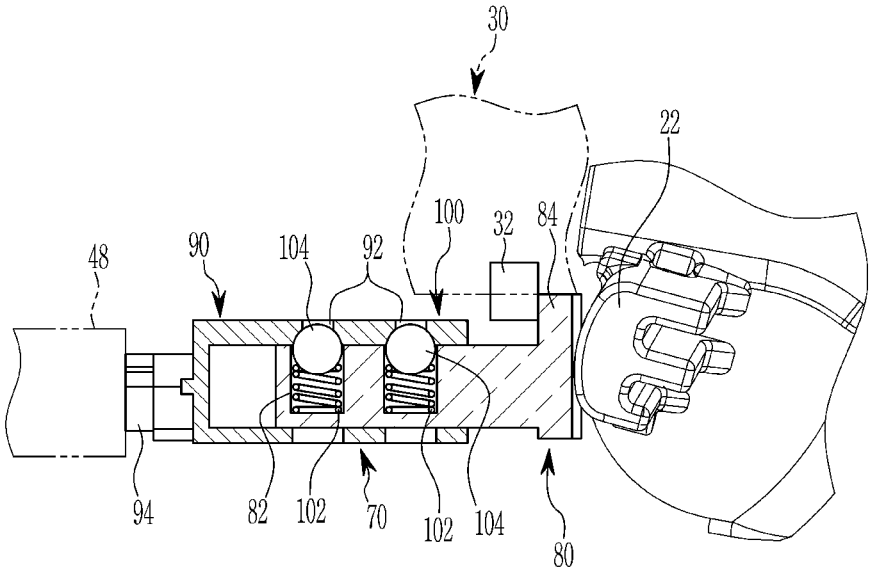
FIG. 3 is a cross-sectional view showing the state before operation of a damage prevention mechanism that can be applied to the retractable outside door handle assembly according to an exemplary embodiment of the present invention.

FIG. 3 is a cross-sectional view showing the state before operation of a damage prevention mechanism that can be applied to the retractable outside door handle assembly according to an exemplary embodiment of the present invention.

Referring to FIG. 1 to FIG. 3, the damage prevention mechanism 70 may include a first body 80 selectively contacting the pushing portion 22, a second body 90 slidably connected to the first body 80 and connected to the operation rod 48, and a selectable locking portion 100 selectively blocking the relative movement of the first body 80 and the second body 90.

Here, when the operation rod 48 pushes the damage prevention mechanism 70, the damage prevention mechanism 70 pushes the pushing portion 22 to rotate the outside handle 20. However, even if the outside handle 20 rotates in the opposite direction and the pushing portion 22 pushes the damage prevention mechanism 70, the damage prevention mechanism 70 does not transmit more than a predetermined force to the operation rod 48 to prevent damage to the actuator 40 by the operation of the selectable locking portion 100.

The selectable locking portion 100 may include a spring housing 82 formed in the first body 80, a stopper elastic portion 102 provided in the spring housing 82, a stopper 104 supported by the stopper elastic portion 102, and a stopper groove 92 formed in the second body 90 and into which the stopper 104 is inserted.

A housing stopper 32 may be formed on the handle housing 30, and a body stopper 84 may be formed on the first body 80 to selectively contact the housing stopper 32.

A connection protrusion 94 may be formed on the second body 90 to connect with the operation rod 48.

Figure 4:
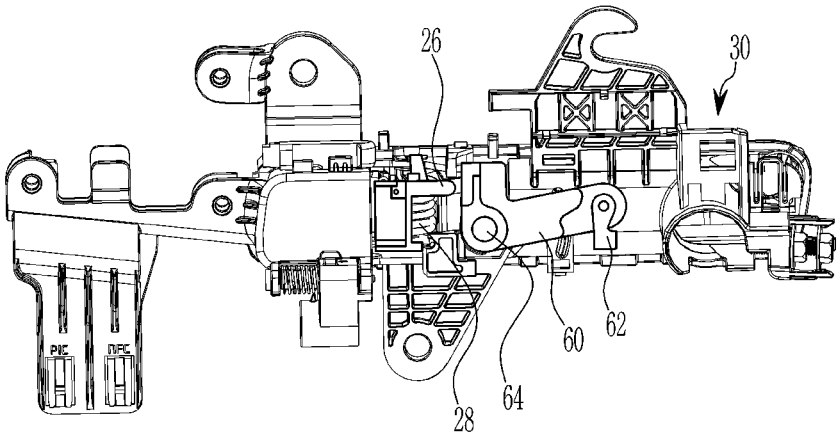
FIG. 4 is a rear view showing the state before operation of the retractable outside door handle assembly according to an exemplary embodiment of the present invention.

FIG. 4 is a rear view showing the state before operation of the retractable outside door handle assembly according to an exemplary embodiment of the present invention.

Referring to FIG. 1 to FIG. 4, the door latch lever 60 is rotatably mounted to the handle housing 30 by the door latch lever pin 64, and the lever hook 62 may be connected to the door latch lever 60. The lever hook 62 is connected to a cable or rod, and when an occupant operates the outside handle 20, the door latch lever 60 rotates to release the connection between the door and the door latch. Since the structure of the connection between the door and the door latch and the cable or rod is obvious to a person skilled in the art, a detailed description will be omitted.

The retractable outside door handle assembly according to an exemplary embodiment of the present invention may further include a handle leg 26 formed on the outside handle 20 to enable contact with the door latch lever 60 when protruding by the operation of the actuator 40.

The retractable outside door handle assembly according to an exemplary embodiment of the present invention may further include a handle spring 28 that provides a reaction torque to the outside handle 20. After the driver or occupant manipulates the outside handle 20, the outside handle 20 can be repositioned into the handle housing 30 by the reaction torque of the handle spring 28.

Hereinafter, an operation of a retractable outside door handle assembly according to an exemplary embodiment of the present invention will be described.

Referring to FIG. 1 to FIG. 4, when the driver or occupant holding the vehicle's smart key approaches the vehicle, or when the vehicle's controller (not shown) initiates the door opening operation by operation of a wireless communication or contact switch, the controller operates the actuator 40.

Then, the operation rod 48 protrudes and pushes the damage prevention mechanism 70, and the damage prevention mechanism 70 pushes the pushing portion 22.

At this time, the stopper 104 is inserted into the stopper groove 92, and the damage prevention mechanism 70 can push the pushing portion 22.

Figure 5:
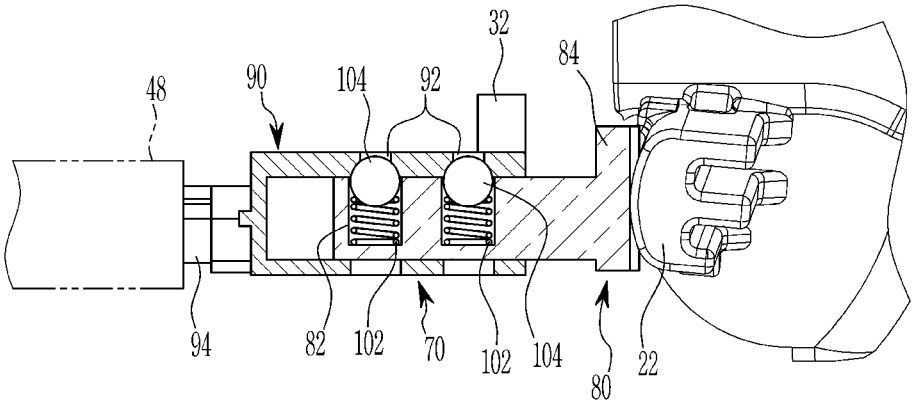
FIG. 5 is a cross-sectional view showing a state during operation of a damage prevention mechanism that can be applied to the retractable outside door handle assembly according to an exemplary embodiment of the present invention.
Figure 6:
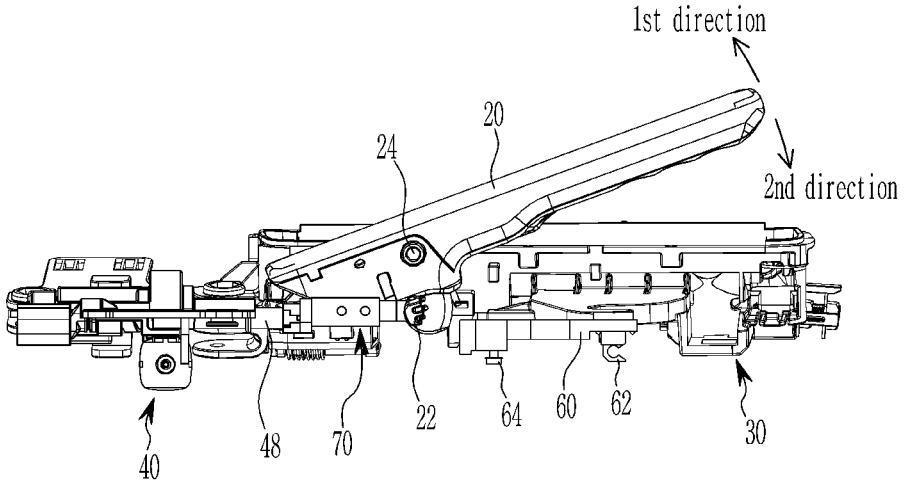
FIG. 6 is a front view of the operation of the retractable outside door handle assembly according to an exemplary embodiment of the present invention.
Figure 7:
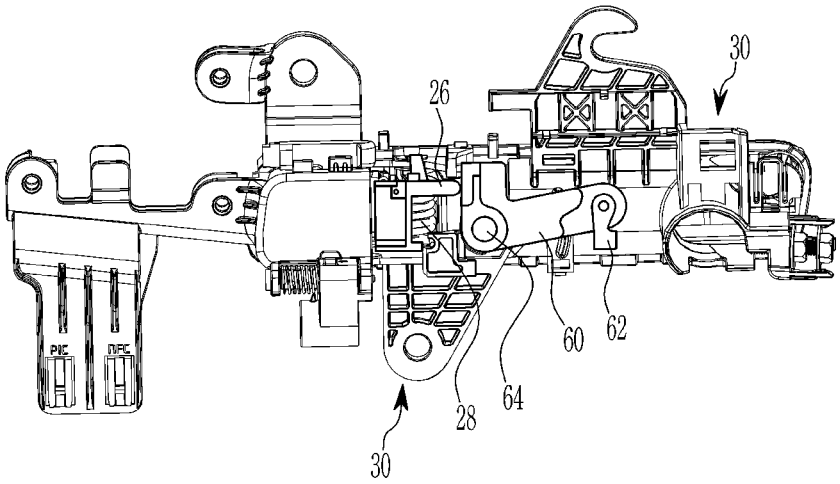
FIG. 7 is a rear view of the operation of the retractable outside door handle assembly according to an exemplary embodiment of the present invention.

FIG. 5 is a cross-sectional view showing a state during operation of a damage prevention mechanism that can be applied to the retractable outside door handle assembly according to an exemplary embodiment of the present invention, FIG. 6 is a front view of the operation of the retractable outside door handle assembly according to an exemplary embodiment of the present invention, and FIG. 7 is a rear view of the operation of the retractable outside door handle assembly according to an exemplary embodiment of the present invention.

Referring to FIG. 5 to FIG. 7, when the damage prevention mechanism 70 pushes the pushing portion 22, the outside handle 20 rotates around the handle rotation pin 24, and the handle leg 26 contacts the door latch lever 60.

At this time, the door latch lever 60 does not rotate, and in this state, the driver or occupant can grip the outside handle 20. This state is defined as the door open standby state.

Figure 8:
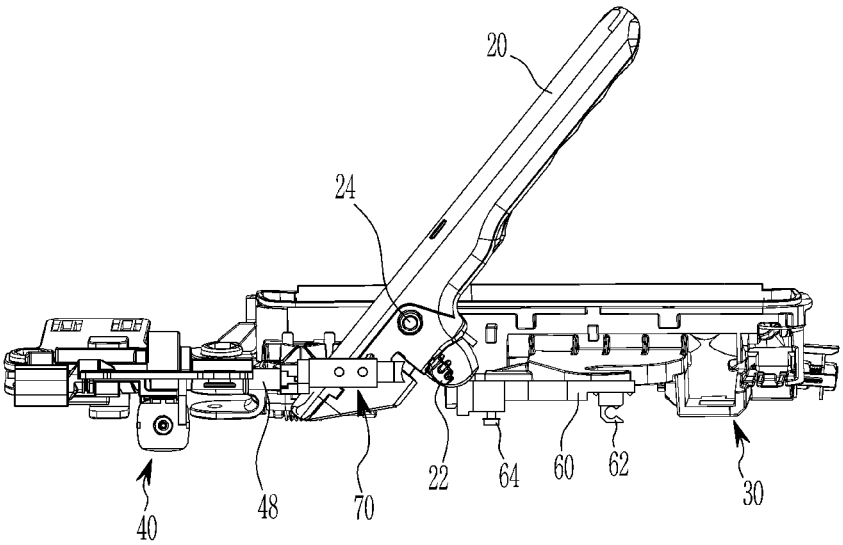
FIG. 8 is a front view of the operation of the outside handle of the retractable outside door handle assembly according to an exemplary embodiment of the present invention.
Figure 9:
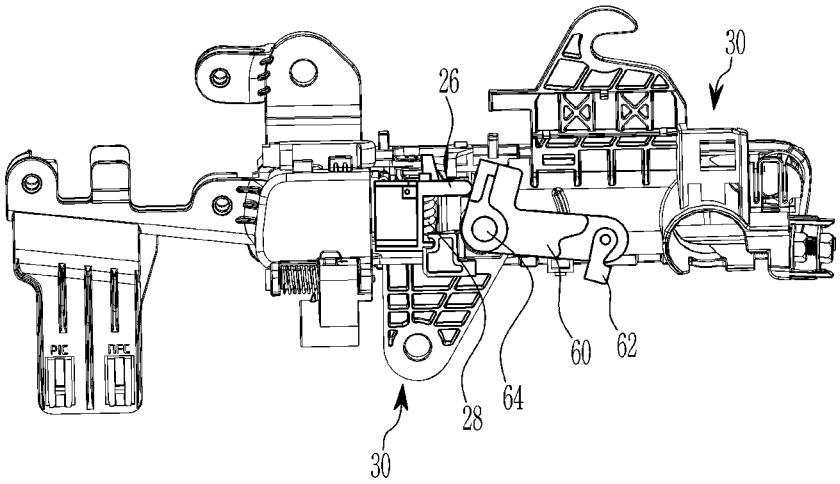
FIG. 9 is a rear view of the operation of the outside handle of the retractable outside door handle assembly according to an exemplary embodiment of the present invention.

FIG. 8 is a front view of the operation of the outside handle of the retractable outside door handle assembly according to an exemplary embodiment of the present invention, and FIG. 9 is a rear view of the operation of the outside handle of the retractable outside door handle assembly according to an exemplary embodiment of the present invention.

Referring to FIG. 8 and FIG. 9, if the driver or occupant pulls the outside handle 20 during the door open standby state, the outside handle 20 rotates around the handle rotation pin 24, that is, in the first direction, and the handle leg 26 pushes the door latch lever 60. Then, the door latch lever 60 rotates around the door latch lever pin 64, and the connection between the door and the door latch is released through a cable or rod (not shown) connected to the lever hook 62.

Figure 10:
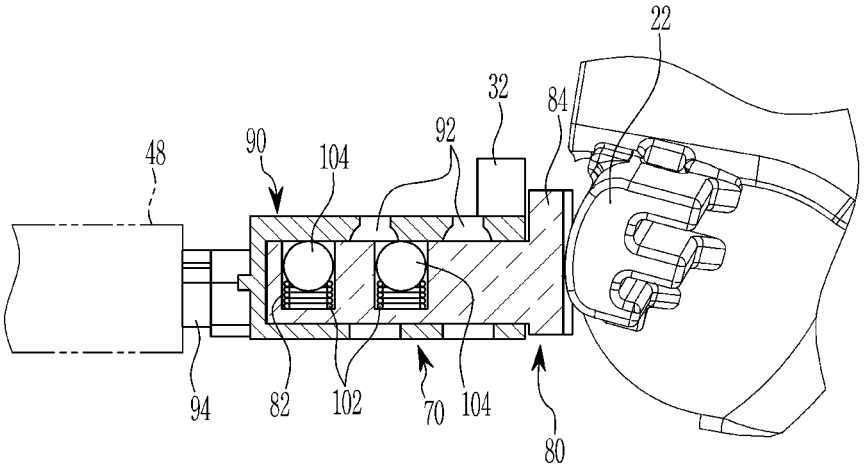
FIG. 10 is a cross-sectional view of a malfunction of the outside handle of the retractable outside door handle assembly according to another exemplary embodiment of the present invention.

FIG. 10 is a cross-sectional view of a malfunction of the outside handle of the retractable outside door handle assembly according to another exemplary embodiment of the present invention.

In the state as shown in FIG. 8, when the driver or occupant forcibly rotates the outside handle 20 in the second direction or the outside handle 20 is rotated in the second direction due to an external impact, the pushing portion 22 pushes the damage prevention mechanism 70, and the operation rod 48 pushes the actuator 40, and the actuator 40 or the pushing portion 22 may be damaged.

However, as shown in FIG. 10, when an abnormal external force is applied to the first body 80, the stopper 104 is separated from the stopper groove 92, and the first body 80 can be inserted into the second body 90. Therefore, the force pushed by the pushing portion 22 is not transmitted to the operation rod 48, thereby preventing damage to the actuator 40 or the pushing portion 22.

After that, when the actuator 40 operates and returns to its original position, that is, the state before the operation, the operation rod 48 also returns to the state before the operation, and the second body 90 moves relative to the left side of the drawing. At this time, the body stopper 84 contacts the housing stopper 32, and the first body 80 is limited in its movement, so it returns to the state shown in FIG. 3.

According to the retractable outside door handle assembly according to an exemplary embodiment of the present invention, damage of parts can be prevented even if the outside handle 20 rotates in reverse due to the occurrence of negligence or external impact of the occupant in the door open standby state.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A retractable outside door handle assembly comprising:

a handle unit including an outside handle having a pushing portion and mounted on a handle housing, wherein the outside handle is configured to protrude by rotating in a first direction;

an actuator including an operation rod configured to selectively push the pushing portion;

a door latch lever rotatably mounted on the handle housing and configured to rotate during protrusion of the outside handle by operation of the actuator when the outside handle is actuated by a user; and a damage prevention mechanism between the operation rod and the pushing portion and configured to push the pushing portion when the actuator is operated;

wherein the damage prevention mechanism is configured to prevent a pushing force greater than a predetermined pushing force of the pushing portion from being transmitted to the operation rod when the outside handle rotates in a second direction opposite the first direction in a protruded state; and wherein the damage prevention mechanism comprises:

a first body selectively contacting the pushing portion;

a second body slidably connected to the first body and connected to the operation rod; and a selectable locking portion configured to selectively block relative movement of the first body and the second body.

2. The retractable outside door handle assembly of claim 1, wherein the selectable locking portion comprises:

a spring housing formed in the first body;

a stopper elastic portion provided in the spring housing;

a stopper supported by the stopper elastic portion; and a stopper groove formed in the second body and into which the stopper is inserted.

3. The retractable outside door handle assembly of claim 2, wherein the second body comprises a connection protrusion configured to connect with the operation rod.

4. The retractable outside door handle assembly of claim 1, further comprising:

a housing stopper formed on the handle housing; and a body stopper formed on the first body and configured to selectively contact the housing stopper.

5. The retractable outside door handle assembly of claim 4, wherein the second body comprises a connection protrusion configured to connect with the operation rod.

6. The retractable outside door handle assembly of claim 1, wherein the second body comprises a connection protrusion configured to connect with the operation rod.

7. The retractable outside door handle assembly of claim 1, wherein the handle unit further comprises a handle rotation pin rotatably mounting the outside handle to the handle housing.

8. The retractable outside door handle assembly of claim 7, wherein the second body comprises a connection protrusion configured to connect with the operation rod.

9. The retractable outside door handle assembly of claim 1, further comprising a handle leg formed on the outside handle and configured to enable contact with the door latch lever when the outside handle protrudes by the operation of the actuator.

10. The retractable outside door handle assembly of claim 1, further comprising a handle spring configured to provide a reaction torque to the outside handle.

11. A retractable outside door handle assembly comprising:

an outside handle having a pushing portion and mounted on a handle housing, wherein the outside handle is configured to protrude by rotating in a first direction;

a handle rotation pin rotatably mounting the outside handle to the handle housing;

an actuator including an operation rod configured to selectively push the pushing portion;

a door latch lever rotatably mounted on the handle housing and configured to rotate during protrusion of the outside handle by operation of the actuator when the outside handle is actuated by a user;

a handle leg formed on the outside handle and configured to enable contact with the door latch lever when the outside handle protrudes by the operation of the actuator;

a handle spring configured to provide a reaction torque to the outside handle; and a damage prevention mechanism between the operation rod and the pushing portion and configured to push the pushing portion during the operation of the actuator;

wherein the damage prevention mechanism is configured to prevent a pushing force greater than a predetermined pushing force of the pushing portion from being transmitted to the operation rod when the outside handle is protruding and rotates in a second direction opposite the first direction; and wherein the damage prevention mechanism comprises:

a first body selectively contacting the pushing portion;

a second body slidably connected to the first body and connected to the operation rod; and a selectable locking portion configured to selectively block relative movement of the first body and the second body.

12. The retractable outside door handle assembly of claim 11, wherein the selectable locking portion comprises:

a spring housing formed in the first body;

a stopper elastic portion provided in the spring housing;

a stopper supported by the stopper elastic portion; and a stopper groove formed in the second body and into which the stopper is inserted.

13. The retractable outside door handle assembly of claim 11, further comprising:

a housing stopper formed on the handle housing; and a body stopper formed on the first body and configured to selectively contact the housing stopper.

14. The retractable outside door handle assembly of claim 11, wherein the second body comprises a connection protrusion configured to connect with the operation rod.

15. A vehicle comprising:

a vehicle body;

a door coupled to the vehicle body;

a handle unit coupled to the door and including an outside handle having a pushing portion and mounted on a handle housing, wherein the outside handle is configured to protrude from an outer surface of the door by rotating in a first direction;

an actuator including an operation rod configured to selectively push the pushing portion;

a door latch lever rotatably mounted on the handle housing and configured to rotate during protrusion of the outside handle by operation of the actuator when the outside handle is actuated by a user; and a damage prevention mechanism between the operation rod and the pushing portion and configured to push the pushing portion when the actuator is operated;

wherein the damage prevention mechanism is configured to prevent a pushing force greater than a predetermined pushing force of the pushing portion from being transmitted to the operation rod when the outside handle rotates in a second direction opposite the first direction in a protruded state; and wherein the damage prevention mechanism comprises:

a first body selectively contacting the pushing portion;

a second body slidably connected to the first body and connected to the operation rod; and a selectable locking portion configured to selectively block relative movement of the first body and the second body.

16. The vehicle of claim 15, wherein the selectable locking portion comprises:

a spring housing formed in the first body;

a stopper elastic portion provided in the spring housing;

a stopper supported by the stopper elastic portion; and a stopper groove formed in the second body and into which the stopper is inserted.

17. The vehicle of claim 15, further comprising:

a housing stopper formed on the handle housing; and a body stopper formed on the first body and configured to selectively contact the housing stopper.

18. The vehicle of claim 15, wherein the second body comprises a connection protrusion configured to connect with the operation rod.

19. The vehicle of claim 15, wherein the handle unit further comprises a handle rotation pin rotatably mounting the outside handle to the handle housing.

20. The vehicle of claim 15, further comprising:

a handle leg formed on the outside handle and configured to enable contact with the door latch lever when the outside handle protrudes by the operation of the actuator; and a handle spring configured to provide a reaction torque to the outside handle.

* * * * *